US006315667B1

(12) United States Patent
Steinhart

(10) Patent No.: US 6,315,667 B1
(45) Date of Patent: Nov. 13, 2001

(54) SYSTEM FOR REMOTE CONTROL OF A MODEL AIRPLANE

(76) Inventor: Robert Steinhart, Talstrasse 17, D-89567 Sontheim (DE)

( * ) Notice: Subject to any disclaimer, the term of this patent is extended or adjusted under 35 U.S.C. 154(b) by 0 days.

(21) Appl. No.: 09/537,900

(22) Filed: Mar. 28, 2000

(51) Int. Cl.[7] ..... A63F 9/24

(52) U.S. Cl. ..... 463/39; 340/825.72; 455/66; 455/345

(58) Field of Search ..... 463/39, 36, 30; 434/29–30, 33, 43, 60–62, 307 R; 701/1–2, 19, 21–22; 340/825.72; 455/66, 344–345, 352; 273/148 B, 148 R

(56) References Cited

U.S. PATENT DOCUMENTS 5,038,144 * 8/1991 Kaye ..... 463/39

5,127,658 7/1992 Openiano .

OTHER PUBLICATIONS

Displays, vol. 4, p. 212, (1993).

* cited by examiner

*Primary Examiner*—Mark Sager
(74) *Attorney, Agent, or Firm*—Cook, Alex, McFarron, Manzo, Cummings & Mehler

(57) ABSTRACT

A system for remote control of a model airplane or similar by an operator has the following characteristics: an image-capturing device which is fitted to the model airplane; a device which is visible to the operator, to display the image information which is captured by the image-capturing device; a device to transmit the image information which is captured by the image-capturing device to the display device; and a device for remote control of the model airplane or similar by the operator.

20 Claims, 2 Drawing Sheets

SYSTEM FOR REMOTE CONTROL OF A MODEL AIRPLANE

The invention concerns a system for remote control of a model airplane or similar by an operator.

In U.S. Pat. No. 5,127,658, a system for remote control of a model airplane, which can be controlled remotely using an operating instrument like a steering rod, is described.

A data helmet, for instance for use by pilots of fighter airplanes, is known in the art from the journal Displays, 1992, Volume 4, page 212.

Remote control systems which are known from the general state of the art consist of a receiver which is fitted to the model airplane and a transmitter which is fitted to a console. For this purpose the console to be carried by the operator usually has several levers, with which various functions of the model airplane can be controlled remotely.

In the course of time, such consoles have become more and more refined, and have been able to take over more and more functions. However, the problem of the remote control systems which are known in the art for model airplanes or similar, i.e. model cars, model ships etc., is that the person controlling the model airplane stands "beside" the thing. The operator therefore experiences flight at a distance, and no true feeling of flight can be aroused.

It is therefore the object of the present invention to create a system for remote control of a model airplane or similar by an operator. The operator obtains feedback from the model airplane, model car, model ship etc. and thus becomes part of the total system.

According to the invention, this object is achieved through the following features: an image-capturing device which is fitted to the model airplane; a device which is visible to the operator, to display the image information which is captured by the image-capturing device; a device to transmit the image information which is captured by the image-capturing device to the display device; and a device for remote control of the model airplane or similar by the operator.

Through the image-capturing device which is fitted to the model airplane, and the image information from said image-capturing device which can be transmitted to a display device which is visible to the operator, the operator is able to see the images which are received by the image-capturing device and to be displaced so directly into the model airplane that the operator obtains a real feedback from what happens with the model airplane which the operator is controlling. The feeling of being the pilot of the model airplane, the driver of the model car or the captain of the model ship is thus conveyed to the operator, and the result is true interaction and the feeling of flying or driving oneself.

According to the invention, a device for remote control of the model airplane or similar by the operator is also provided, so that the operator has full control of the model airplane and is thus integrated into the remote control system according to the invention.

In a very advantageous development of the invention, if a device for remote control of the image-capturing device by the operator is provided, the operator can change his or her field of vision in relation to the display device, and the feeling of flight can be experienced even more directly.

In an advantageous realization of the invention, it can be provided that the device for remote control of the image-capturing device is fitted in or on a device which is fitted to the operator's head.

In this way, the operator is able to change the image-capturing device of the model airplane by head movements.

This means that, for instance, if the operator wants to look at the objects in the right-hand area of vision of the image-capturing device, only a turn of the head in the corresponding direction is necessary.

For this purpose, in a simple development, it is possible to provide that sensors, via which the image-capturing device can be controlled remotely by movements of the operator's head, are fitted to the device which is fitted to the operator's head.

The operator can be even more thoroughly integrated into the remote control system and the movements of the model airplane if the device to display the image information which is captured by the image-capturing device is fitted to the device which is fitted to the operator's head. The operator thus has the images which the image-capturing device sends to the display device even better in his or her field of vision.

A very simple realization results if the device which is fitted to the operator's head is in the form of a data helmet.

In a very advantageous manner, the model airplane can be controlled remotely by movements of the operator's limbs, if in a development of the invention the device for remote control of the model airplane has sensors which are fitted to at least one of the operator's limbs.

The sensors can be realized in an advantageous manner if they have gas bubbles in a closed mass of liquid.

This basic principle can be used in various analog or digital types of sensors.

In another advantageous version, if the sensors are fitted to the operator's arms, the result is that the operator is able, by movements of the arms, to control the model airplane remotely, and in association with observing the image information of the image-capturing device which is fitted to the model airplane, this is a true interaction, giving an almost real feeling of flight.

Other advantageous realizations and developments of the invention follow from the remaining subclaims and from the embodiment which is presented in principle below on the basis of the drawing, in which FIG. 1 shows a system according to the invention, for remote control of a model airplane, with such a model airplane;

Figure 1:
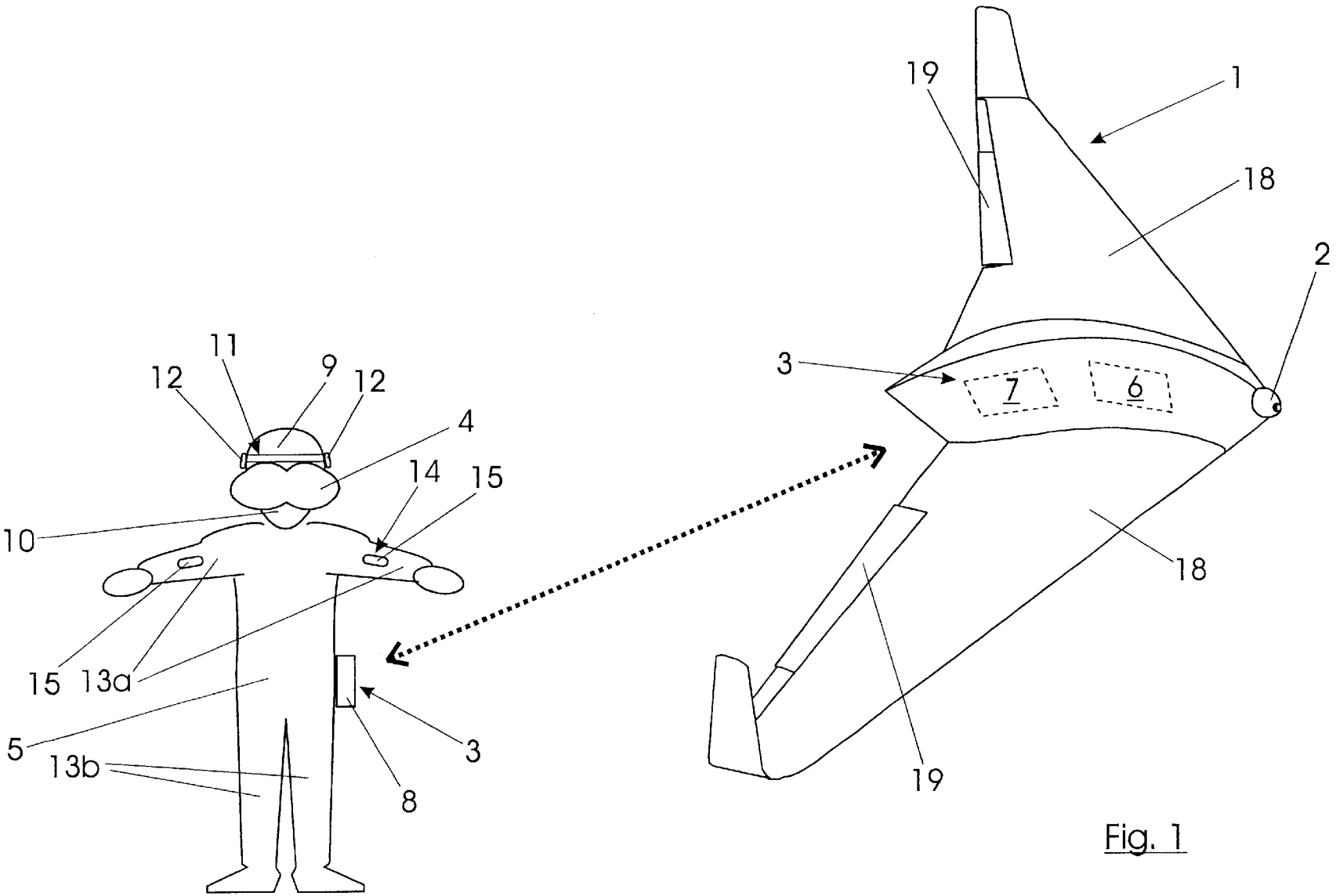
Figures 2, 3, 4, 5, 6:
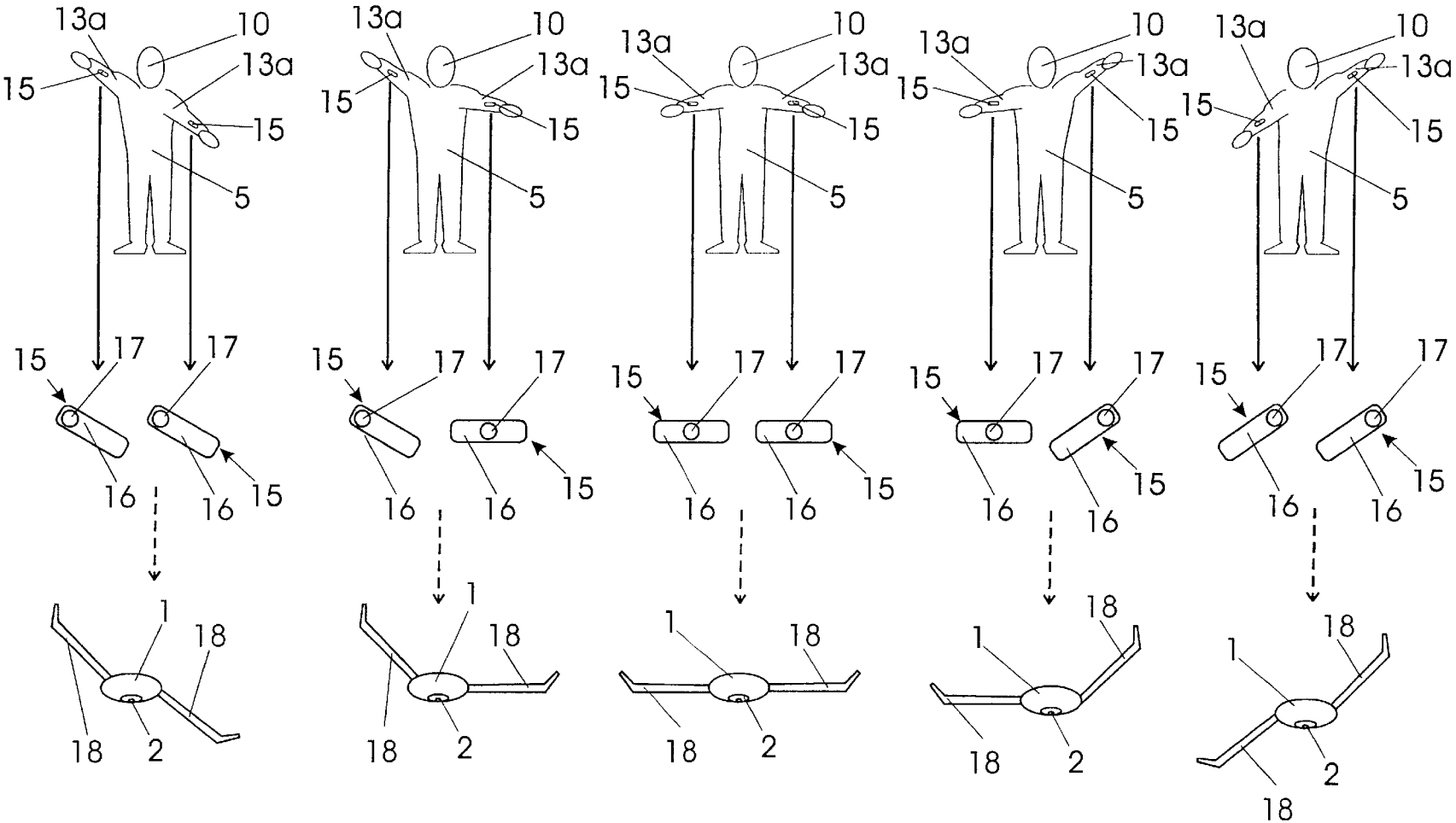
FIG. 2 shows a first flight state of the model airplane, with the associated arm position of the operator.
FIG. 3 shows a second flight state of the model airplane, with the associated arm position of the operator.
FIG. 4 shows a third flight state of the model airplane, with the associated arm position of the operator.
FIG. 5 shows a fourth flight state of the model airplane, with the associated arm position of the operator.
FIG. 6 shows a fifth flight state of the model airplane, with the associated arm position of the operator.

FIG. 1 shows a model airplane 1, in the nose of which an image-capturing device 2, namely in this case a very small video camera 2, is fitted. Additionally, on the model airplane 1 there is a device 3, which is able to transmit the image information which is captured by the video camera 2 to a display device 4 which is visible to an operator 5. Device 3 is therefore called transmission device 3 below.

In the present embodiment, the transmission device 3 includes an image data converter 6, a data processing device 7 which is fitted in the model airplane 1, with an integrated transmitter to transmit the image information, and a data processing device 8, with an integrated receiver to receive the image information. The image data converter 6 receives the incoming image information from the video camera 2, converts it into corresponding data, and first passes it on to the data processing device 7. From there, the data is passed on to data processing device 8 by telecommunications—taking account of the most modern radio standards (e.g. WCDMA=Wideband Multiple Access or UMTS=Universal Mobile Telecommunications System). Alternatively, data transmission via other telecommunication devices, e.g. a mobile telephone, would also be possible. Data transmission device 8 is in the area of the operator 5, in the present case on a belt which is not shown, but is to be worn by the operator 5. Thus a part of the transmission device 3 is provided in the area of, or on, the operator 5.

Data processing devices 7 and 8 may be, for instance, computers of the Pentium II type with 266 MHz and 64 megabytes of working memory, and very small size. Obviously, other computers are suitable as data processing devices 7 and 8, if they are of suitable size to find space on the model airplane 1 or operator 5 respectively.

Data processing device 8 converts the video signals which are received from data processing device 7 into RGB signals, and passes these signals on, in a manner which is not shown, to the display device 4.

The display device 4 is fitted to another device 9, which is in the form of a data helmet 9, and which is on the head 10 of the operator 5, or which the operator 5 carries on his or her head 10. The display device 4 consists in the present case of two 1.3" screens which are not shown, with a resolution of 640×480 to 1024×768 pixels. Other display devices 4 can of course be used if they are suitable.

The data helmet 9 is also equipped with a device 11 for remote control of the video camera 2. The remote control device 11 has sensors 12 which detect the movements of the head 10 of the operator 5. In this way, the video camera 2 which is fitted in the model airplane 1 can be controlled remotely, i.e. moved in different directions, by movements of the head 10 of the operator 5. The result, because of the transmission of the image information by the transmission device 3 to the display device 4 as described above, is exactly the view into which the head 10 of the operator 5 is turned. In other words, the operator 5 can take over the angle of vision of the model airplane 1, and thus be displaced into the model airplane 1.

On the limbs 13, in this case the arms 13*a* of the operator 5, a device 14 for remote control of the model airplane 1 is fitted. This device is therefore also called the remote control device 14. The remote control device 14 also has sensors 15, and the model airplane 1 can thus be controlled remotely by movements of the arms 13 of the operator 5. Alternatively, it would be possible to control the model airplane 1 using the legs 13*b* or other body parts of the operator 5, or the sensors 15 of the remote control device 14 could also be fitted, in a manner which is not shown, on rods or similar to be held in the hands of the operator 5.

In embodiments which are not shown, the sensors 15 could also conceivably be fitted to data gloves, shoes, trousers or a complete data suit.

However, alternatively the operator 5 can also use only the display device 4, and to control the model airplane 1 use a traditional operating console (not shown) for remote control.

As can be seen in FIGS. 2 to 6, the two sensors 15 are formed on the principle of a spirit level, and have gas bubbles 17 in a closed mass of liquid 16. How sensors 15 which work on this principle function is itself known in the art, and is therefore not described in more detail below. As can also be seen in FIGS. 2 to 6, different positions of the arms 13*a* result in different control signals at the sensors 15, which results in a change of the angle of ailerons 19 which are fitted on wings 18 of the model airplane 1. The ailerons 19 of the wings 18 are shown only in FIG. 1. The change of the angle of the ailerons 19 results in different flight states of the model airplane 1, as can be seen in FIGS. 2 to 6. Obviously, the reaction of the ailerons 19 to the different positions of the arms 13*a* also depends on the type of model airplane 1, and can also be changed or adjusted as much as desired.

The ailerons 19 can have joints which are not shown and which can be pivoted by electric motors, which are also not shown. Then, so that the ailerons 19 can be pivoted, the electric motors must be activated by the sensors 15.

The transmission of data from the sensors 12 and 15 to the video camera 2 and to the electric motors of the model airplane 1 can be by telecommunications, e.g. radio or through a mobile telephone.

Instead of the present model airplane 1, with the same devices as described above,it would also be possible to control a model car, model ship or similar remotely. The propulsion of the model airplane or similar can be of conventional construction, and can also be controlled by the remote control device 14.

What is claimed is:

1. A system for remote control of a model (1) by an operator (5), with the following characteristics:

1.1 an image-capturing device (2) which is fitted to the model (1), 1.2 a device (4), which is visible to the operator (5), to display the image information which is captured by the image-capturing device (2), 1.3 a device (3) to transmit the image information which is captured by the image-capturing device (2) to the display device (4), 1.4 a device (14) for remote control of the model (1) by the operator (5).

2. The system as claimed in claim 1, wherein a device (11) for remote control of the imagecapturing device (2) by the operator (5) is provided.

3. The system as claimed in claim 2, wherein the device (11) for remote control of the image-capturing device (2) is fitted in or on a device (9) which is fitted to the head (10) of the operator (5).

4. The system as claimed in claim 3, wherein sensors (12), by which the image-capturing device (2) can be controlled remotely by movements of the head (10) of the operator (5), are fitted to the device (9) which is fitted to the head (10) of the operator (5).

5. The system as claimed in claim 3, wherein the device (4) to display the image information which is captured by the image-capturing device (2) is fitted to the device (9) which is fitted to the head (10) of the operator (5).

6. The system as claimed in claim 3, wherein the device which is fitted to the head (10) of the operator (5) is a data helmet (9).

7. The system as claimed in claim 6, wherein the display device (4) has at least one screen which is fitted to the data helmet (9).

8. The system as claimed in claim 1, wherein the image-capturing device (2) is a video camera.

9. The system as claimed in claim 1, wherein the device (14) for remote control of the model airplane (1) has sensors (15) which are fitted to at least one of the limbs (13) of the operator (5).

10. The system as claimed in claim 9, wherein the sensors (15) are fitted to the arms **(13*a*) of the operator (5)**.

11. The system as claimed in claim 9, wherein the sensors (15) have gas bubbles (17) in a closed mass of liquid (16).

12. The system as claimed in claim 1, wherein the transmission device (3) has two data processing devices (7, 8), of which one data processing device (7) is fitted to the model (1) and the other data processing device (8) is fitted to the operator (5).

13. The system as claimed in claim 12, wherein the image information is transmitted from one data processing device (7) to the other data processing device (8) by radio.

14. The system as claimed in claim 12, wherein the image information is transmitted from one data processing device (7) to the other data processing device (8) by a mobile telephone.

15. The system as claimed in claim 1, wherein the transmission device (3) has an image data converter (6).

16. The system as claimed in claim 15, wherein the image data converter (6) is fitted to the model airplane (1).

17. The system as claimed in claim 1, wherein the remote control of the model (1) by the remote control device (14) is by radio.

18. The system as claimed in claim 1, wherein the remote control of the model (1) by the remote control device (14) is by a mobile telephone.

19. The system as claimed in claim 2, wherein the remote control of the image-capturing device (2) by the remote control device (11) is by radio.

20. The system as claimed in claim 2, wherein the remote control of the image-capturing device (2) by the remote control device (11) is by a mobile telephone.

* * * * *